United States Patent [19]

Ammann et al.

[11] 4,060,409

[45] Nov. 29, 1977

[54] MECHANICALLY STIRRED FURNACE FOR PYROMETALLURGICAL OPERATIONS AND PROCESSES

[75] Inventors: Paul R. Ammann, Boxford; Peter B. Crimes, Sudbury; Jonathan J. Kim, Chelmsford, all of Mass.

[73] Assignee: Kennecott Copper Corporation, New York, N.Y.

[21] Appl. No.: 660,147

[22] Filed: Feb. 23, 1976

[51] Int. Cl.[2] ..... C22B 9/02; C21C 5/52; H05B 7/18

[52] U.S. Cl. ..... 75/93 R; 13/9 R; 75/12; 75/61

[58] Field of Search ..... 75/61, 93 R, 10, 12; 13/9

[56] References Cited

U.S. PATENT DOCUMENTS

| | | | |
|---|---|---|---|
| 3,160,497 | 12/1964 | Loung | 75/10 R |
| 3,567,204 | 3/1971 | Ando | 75/61 |
| 3,773,498 | 11/1973 | Eichbaum | 75/61 |
| 3,824,095 | 7/1974 | Ando | 75/61 |

*Primary Examiner*—Peter D. Rosenberg
*Attorney, Agent, or Firm*—Anthony M. Lorusso; John L. Sniado

[57] ABSTRACT

The present specification discloses a pyrometallurgical system for maintaining a material in a molten state, the system comprising a vessel for molten material, the vessel conceptually dividable into a number of substantially uniform cells. A mechanical stirrer is provided for each such cell and is centered within the cell. The stirrers are sized and driven at a rate so as to promote a uniform temperature and composition of the molten material and improved heat transfer between, and blending of, various constituents of molten material, while producing minimal erosion of the conventional refractory lining of the vessel. Preferably, adjacent pairs of stirrers are driven with opposite rotational senses, thereby assuring reinforcing flow patterns at the cell boundaries. Heating means (e.g., power electrodes) are provided at locations which do not substantially interfere with the flow patterns generated by the array of mechanical stirrers.

12 Claims, 7 Drawing Figures

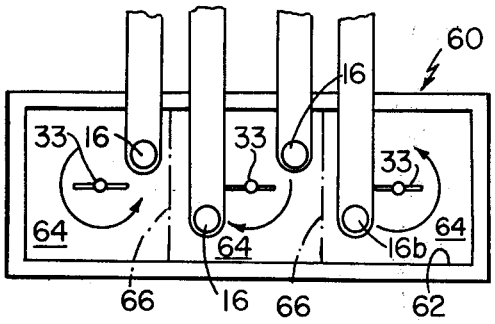
FIG. 5A
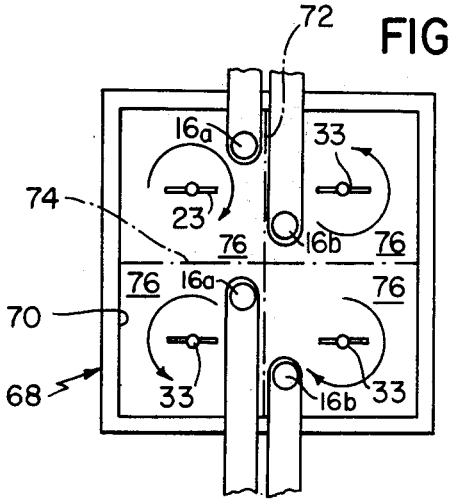
FIG. 5B
FIG. 4A
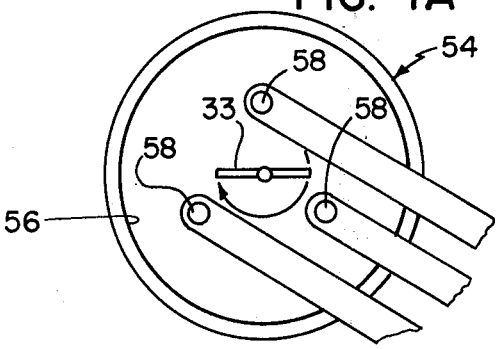
FIG. 4B
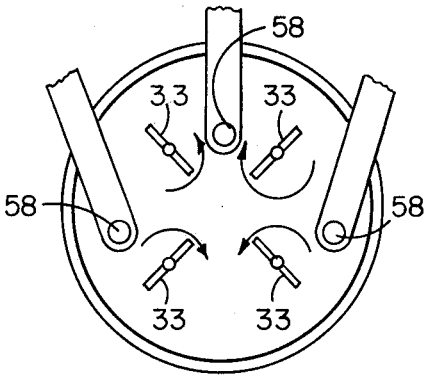

MECHANICALLY STIRRED FURNACE FOR PYROMETALLURGICAL OPERATIONS AND PROCESSES

BACKGROUND OF THE INVENTION

The present invention is directed to an improved pyrometallurgical furnace or reactor. In particular, the invention concerns such a furnace or reactor which incorporates a series of interrelated mechanical stirrers.

While not limited thereto, the features of the present invention are particularly suitable for incorporation into electric arc pyrometallurgical furnaces. Electric arc furnaces have been employed in various circumstances, such as melting and refining iron or steel, smelting ores or sulfide concentrates, and high temperature holding furnaces for cleaning slag or melting and refining copper. While there have been various basic electric arc furnace configurations (the most important of which are discussed below), in addition to the absence of mechanical stirrers in each such configuration, it should be noted that the design of the furnace, and in particular the shape of the vessel which holds the molten material, heretofor has been dictated by the placement of the power electrodes.

A very common prior art furnace design is the "in-line furnace" which is often used in smelting operations. A number (e.g., six) of electrodes are positioned along the centerline of a rectangular furnace and project downwardly into the molten material. This type of furnace has been used, for example, for smelting ilmenite ore.

Round furnaces which can be used for melting and refining metals such as scrap iron or copper, operate on three phase electric power and employ three electrodes positioned at the apexes of an isosceles triangle centered about the center of the circular furnace. When melting metals which can absorb the energy, these furnaces may operate at higher power levels than a typical "in-line" furnace.

While "in-line" and round furnaces are most common, other types have been proposed. One example is something of a hybrid between the "in-line" and the "round" furnaces discussed above, and has been used for cleaning certain types of slags in the copper and nickel industries. This furnace is oval in shape and includes two sets of electrodes for receiving both three-phase power and two-phase power. Both the three electrodes of the three-phase system and the two electrodes of the two-phase system are in an "in-line" configuration.

Despite their design differences, these prior art furnaces have in common the dictation of furnace design by the required electrode array geometry and the absence, other than the electrode geometry and the furnace shape, of any effective means for dispersing the power delivered to the molten material to obtain a uniform temperature throughout the molten material. Additionally, the intimate contact between various phases constituting the molten material, required for enhancing various reactions, has been difficult to achieve. These limitations of prior art furnaces have been vexing problems in the industry. Thus, in a typical prior art "in-line" furnace not only does the heat supplied by the electrodes get concentrated, in a horizontal plane, along the centerline of the furnaces, but, since the electrodes typically just touch the surface of the molten material, a substantial vertical temperature gradient is produced in the furnace. For example, it is not uncommon that a temperature gradient of 150° F can develop between the top and bottom of a furnace having a depth of only 3 to 6 feet. (While the prior art electrodes have been mounted to permit height adjustment, at any given position in molten material they deliver power preferentially to a given level in the molten material.) The non-homogeneous temperature is accompanied by a non-homogeneous composition of the material within the vessel, as well. Thus, various high melting components of the molten material can freeze out at or near the boundary of the slag-matte interface. This not only decreases the efficiency of the reactions desired within the molten material, but can reduce the effective volume of the furnace as frozen matter builds up within the vessel.

Mention should also be made of U.S. Pat. No. 3,861,660 entitled "Pyrometallurgical System With Fluid Cooled Stirrer", issued Jan. 21, 1975 and owned by the Assignee of the present invention. While that patent is not directed to an electric arc furnace, the suggestion of the patent as a whole is that the improved stirrer described and claimed therein is suitable for use in a wide variety of pyrometallurgical systems. While that patent mentions the possible use of the stirrer in electric furnaces, there is no suggestion of what form a large furnace employing such a mechanical stirrer would take.

Accordingly, it is an object of the present invention to provide a pyrometallurgical system with improved uniformity of temperature, and homogeniety of composition, in the molten bath.

A further object of the invention is to provide such a furnace which may be operated at high power densities.

A further object of the invention is to provide an electric arc furnace which can achieve uniform temperatures in the molten bath while permitting more flexibility in the selection of electrode placement.

A further object is to provide a pyrometallurgical system capable of enhancing reactions between constituent materials of the molten bath.

SUMMARY OF THE INVENTION

These and other objects of the invention are accomplished by a pyrometallurgical system which comprises a vessel for molten material, the vessel having an internal shape in a horizontal cross section which is conceptually dividable into a predetermined number of substantially equiaxed cells. An array of stirrers projects into the vessel for stirring molten material therein with each stirrer being substantially centered in a cell. Drive means are provided for rotating each stirrer with a predetermined sense of rotation. (Preferably, the rotations of each pair of adjacent stirrers are of opposite senses, thereby assuring the reinforcement of flow at the cell boundaries.) Heating means project into the vessel at locations which are chosen to avoid interference with the flow patterns generated by the stirrers.

BRIEF DESCRIPTION OF THE DRAWINGS

Other objects, features, and advantages of the invention will appear from the following description of a particular preferred embodiment taken together with the accompanying drawings in which;

FIGS. 4 and 4B are schematic illustrations of round furnaces incorporating features of the present invention; and FIGS. 5A and 5B are schematic illustrations of additional electric arc furnaces incorporating features of the present invention.

DETAILED DESCRIPTION OF PARTICULAR PREFERRED EMBODIMENTS

Figure 2:
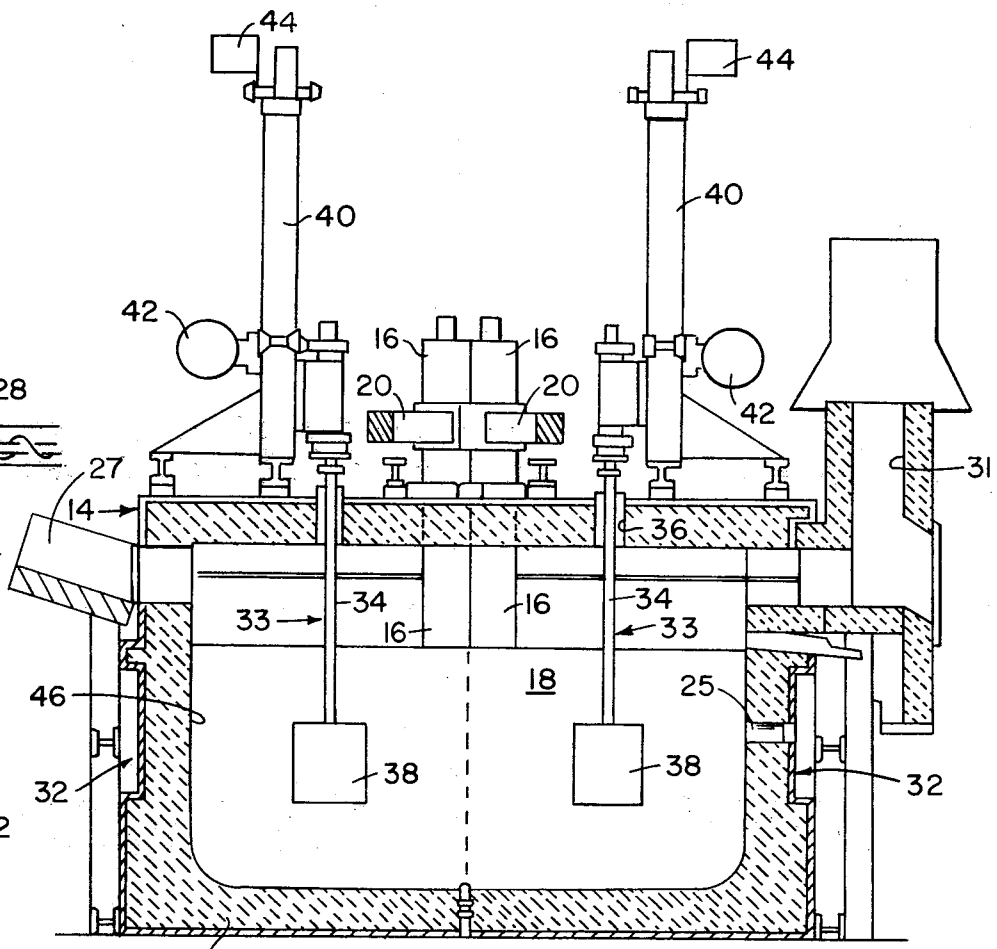
FIGS. 1, 2, and 3 are, respectively, end, side, and top views, partially broken away, of an electric arc furnace constructed in accordance with the present invention.
Figure 1:
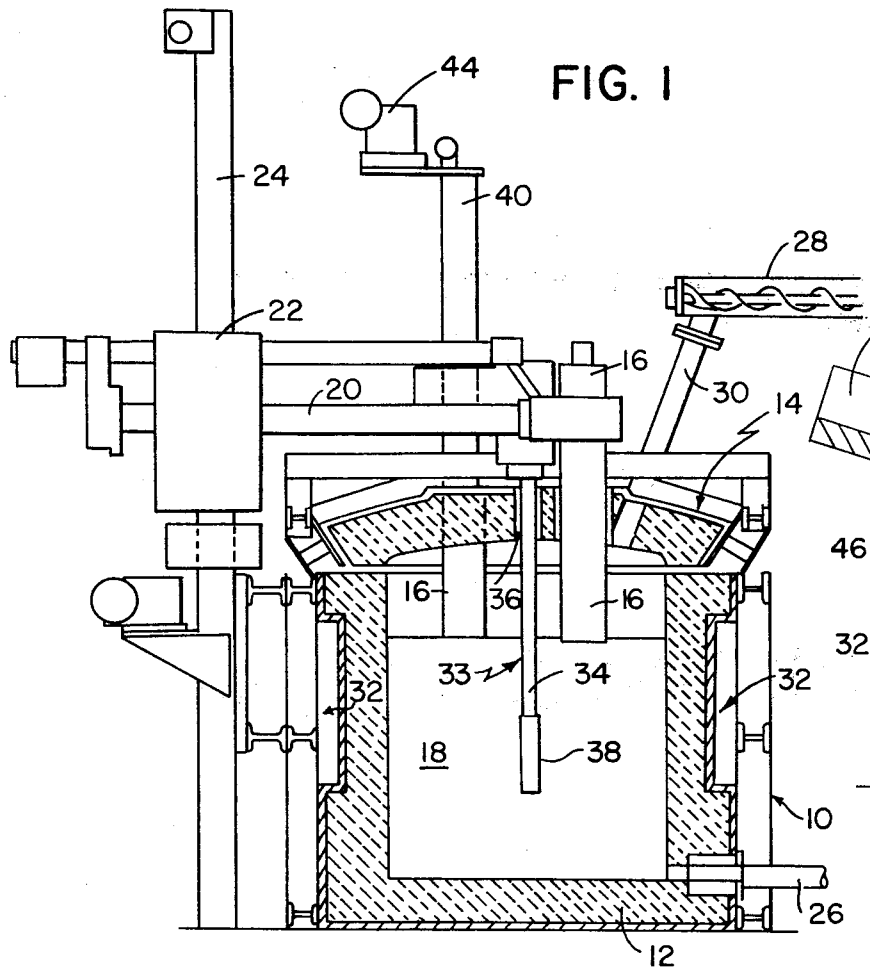
Figure 3:
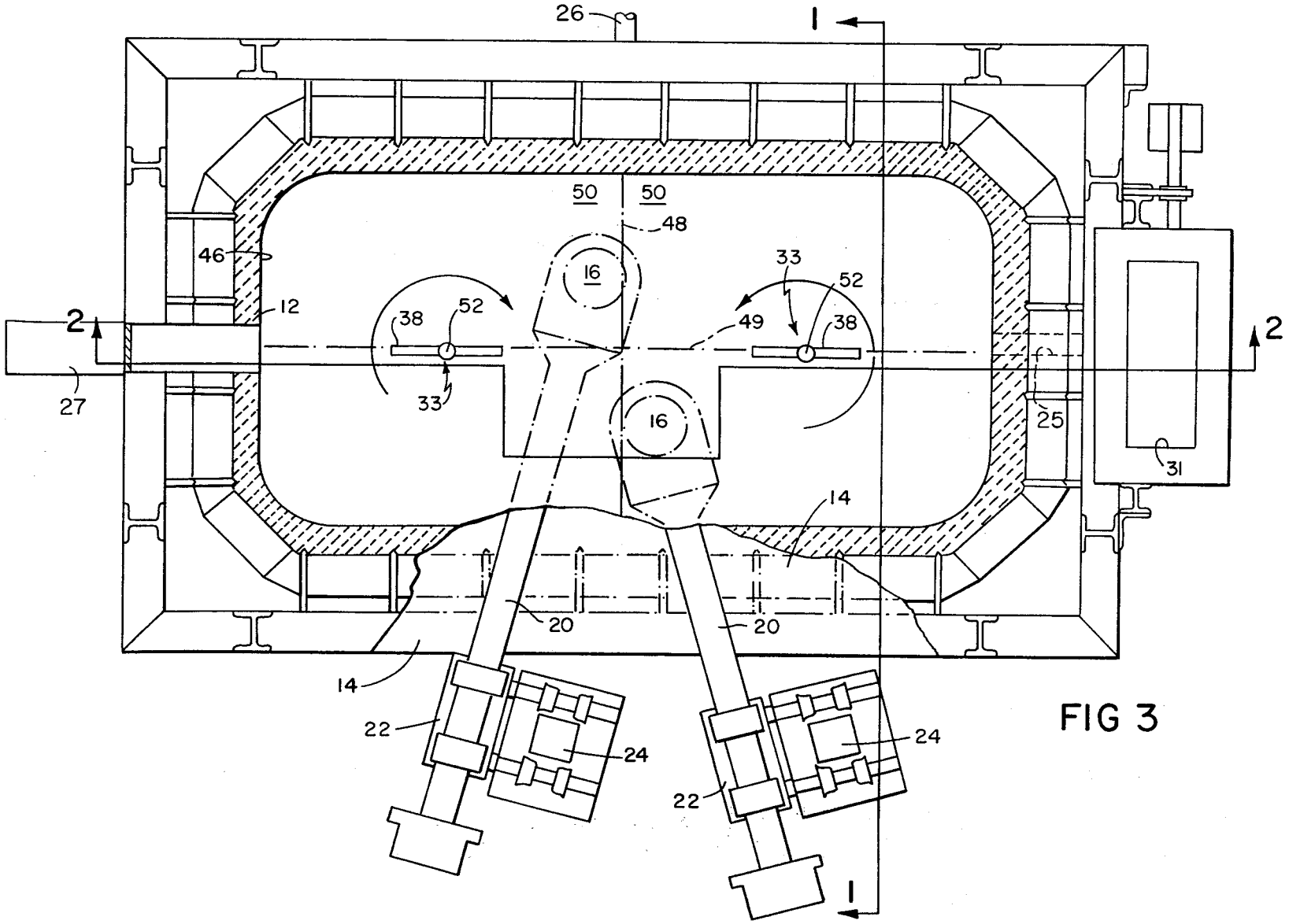

FIGS. 1–3 illustrate an electric furnace 10 formed as a metal box having a refractory lining 12 and a refractory lined cover 14. Openings in the cover 14 permit electrodes 16 to project downwardly into the furnace contacting the surface of a molten material 18. The electrodes are held by supports 20 which are in turn held in a frame 22 that can be maintained at various heights on a vertically disposed beam 24, thereby permitting the adjustment of the height of the electrodes. The furnace may also include such conventional features as an exit conduit 25 for removing treated slag, an exit conduit 26 for tapping heavy constituents of the molten material 18 which settle at the bottom of the vessel, a launder 27 for feeding molten slag to the furnace, a screw conveyor 28 and conduit 30 arrangement for feeding matter to the molten material 18, cooling means (not shown) provided in recesses 32 of the furnace walls to protect the walls from heat damage, and an exhaust chimney 31 for removing any excess vapors produced by reactions within the vessel. Also provided are a pair of mechanical stirrers 33, each comprising a shaft 34 projecting downwardly through an opening 36 in the vessel cover 14 and a blade 38 submerged in the molten material 18. Each stirrer is supported for rotation with respect to a fixed stirrer support 40 and is driven by a motor 42. The entire assembly consisting of the stirrer and the motor 42 can be raised and lowered with respect to the support 40 by means of a second motor 44 linked to that assembly by a chain.

As best seen in FIG. 3, each stirrer 33 is centered in a substantially square segment of the internal volume 46 of the furnace. In the illustrated embodiment, the volume 46 is approximately twice as long as it is wide so that the volume 46 may be conceptually divided by a reference line 48 into two equally sized, substantially uniform unit cells 50. Since each stirrer 33 is centered within a cell 50, the reference line 48 bisects, and is perperdicular to, reference line 49 drawn between the axes of rotation 52 of the stirrers 33. As indicated by the arrows in FIG. 3, the stirrers are driven with opposite rotational senses so that the flow patterns generated by each stirrer reinforce each other at the interface of cells 50 (i.e., small sample volumes of molten material adjacent each side of reference line 48 will both be moving generally from top to bottom as viewed in FIG. 3).

Because of the mixing action of the stirrers, it has been found that the electrodes 16 can be located at unconventional positions within the furnace and still achieve good uniformity of temperature throughout the molten material, as well as a lack of heat damage to the refractory walls of the vessel. Thus, in the embodiment of FIG. 3, the electrodes 16 have been diagonally located on opposite sides of each of the reference lines 48 and 49. Absent the stirrers 33 centered in the unit cells 50, of course, such an electrode placement would be disastrous, causing serious heat damage to the refractory walls near the electrodes and resulting in the freezing of slag at the corners of the vessel remote from the electrodes. Furthermore, it is found that the diagonal placement of the electrodes with respect to the two reference lines 48, 49 is less disruptive of the flow patterns generated by the stirrers than more conventional placements, and is preferred for that reason.

As is evident from FIG. 3, and as is well known to those skilled in the art, pyrometallurgical crucibles are seldom dividable precisely into uniform squares. Thus, for example, in the furnace of FIG. 3, since the crucible corners are rounded, each of the unit cells 50 has two rounded corners and two square corners (the latter being those corners adjacent the reference line 48). It should thus be emphasized that for purposes of the present invention exact precision and uniformity of the unit cells 50 is not required. It is preferred, however, that each unit cell 50 be substantially equiaxed (i.e., all straight lines passing through the center of the cell being approximately the same length) so that each stirrer 33 can mix the entire contents of the unit cell without excessive turbulence at one portion of the unit cell and/or dead spaces at another portion.

EXAMPLE

A pilot electric arc furnace was set up according to the plan of FIGS. 1–3. The interior crucible dimensions were 8 feet long by 4 feet wide by 3 and one half feet deep. The reference line 48 thus divided the crucible conceptually into two unit cells, each approximately 4 feet by 4 feet. Mechanical stirrers 33 were supported to be centered in each of those cells. Two 8 inch electrodes 16 were installed as shown in FIG. 3 on opposite sides of the reference line 48 and on opposite sides of the reference line 49. This furnace was loaded with 6 tons of molten slag delivered to the furnace from a ladle through launder 27. The temperature of the molten slag as it is delivered was about 2400° F. The 6 tons of molten slag filled the furnace to a depth of about 24 inches. Power delivered through the electrodes 16 maintained the slag at a temperature of about 2400° F. The composition of the slag was as follows:

35%: Iron
33%: $SiO_2$
1%: Copper
5–10%: $Ee_3O_4$
0.3%: Molybdenum
(Balance): Other ingredients While the slag was maintained in its molten condition, the two stirrers were rotated with opposite senses or rotation at rotational speeds of about 50 RPM. Subsequently, about 2 tons of solid slag, crushed or granulated to an average diameter of about ¼ inch was introduced through screw conveyor 28 at the rate of about ½ ton per hour for 4 hours. As the solid crushed slag was being fed to the furnace, the stirrer speed was increased to 100 RPM. At the end of the 4 hour period, the additional 2 tons of slag increased the depth of molten material in the furnace to about 32 inches. During the melting of this added solid slag, the power in the furnace was maintained in the range of 600–700 kilowatts. After the solid slag had been added and melted, coal was added through the screw feed 28 to cover the surface of the slag to prevent oxidation. The stirrers were than rotated with a speed of 100 RPM for about 20, minutes, again with opposite senses of rotation. As a result of these operations, molybdenum was extracted from the slag into an alloy which formed at the bottom of the slag. After 20 minutes, the rotational rate of the stirrers was reduced to 50 RPM and the slag was withdrawn through slag port 25. The entire process was then repeated with successive cycles until the amount of alloy collected in the bottom of the vessel reached a substantial level. The alloy was drained off through the conduit 26. Typically, the alloy, as drawn off from the vessel, contained about 70% to about 80% iron, about 5% sulfur, and the remainder molybdenum and copper. As a result of the operations described, the composition of the slag changes from an initial composition including about 0.37% molybdenum and about 1% copper to a composition of the slag which leaves the vessel having about 0.02% to about 0.04% molybdenum and about 0.4% copper.

FIGS. 4A, 4B, 5A, and 5B illustrate other electric arc furnace configurations employing the unit cell arrangement, the mechanical stirrers, and the positioning of the electrodes to avoid impeding the flow patterns generated. Referring first to FIGS. 4A and 4B, a furnace 54 has a crucible 56 with a circular cross section in a horizontal plane. Such furnaces have been used with three symmetrically located electrodes 58 connected to receive three-phase electric power. The symmetrical (i.e., isosceles) positioning of the electrodes conduces to a relatively uniform delivery of power to the upper levels of the molten material. Because of the existing symmetry of the crucible 56 in FIG. 4A, a mechanical stirrer 33 is centered within the crucible. The vertical circulation of molten material produced by the stirrer results in a relatively homogeneous vertical distribution of power and permits operation at relatively high power levels. With large circular furnaces, of course, multiple unit cells such as shown in FIG. 4B, with a stirrer for each cell, could be conceptually defined by reference lines along diameters of the circle.

The furnace 60 of FIG. 5A is similar in shape to that of FIGS. 1–3 but comprises a longer, narrower rectangle necessitating the conceptual division of the crucible 62 into three unit cells 64 by reference lines 66. A mechanical stirrer 33 is centered in each of the cells 64 with each adjacent pair of stirrers having rotations of opposite senses, thereby assuring reinforcement of flow at the cell boundaries. A pair of electrodes 16 is supported in the off-set diagonal manner, described in relation to FIG. 3, adjacent each of the reference lines 66. Such a furnace may typically be approximately thirty feet long and ten feet wide and is thus divided into unit cells 64 that are ten feet by ten feet. A furnace of this configuration may be used as one stage of a "copper cleaning furnace".

The furnace 68 of FIG. 5B includes a crucible 70 that is already square in cross section, but is of such size (e.g., 20 feet by 20 feet) as to make a single stirrer centered in the crucible impractical. Thus, the crucible 70 is conceptually divided by reference lines 72 and 74 into four unit cells 76 each having a mechanical stirrer 33 centered therein. Paired electrodes 16*a* and 16*b* are again provided in the off-set diagonal relation with respect to the pairs of adjacent cells and the stirrers 33 are rotated such that each adjacent pair of stirrers has an opposite rotational sense thereby again assuring reinforcement of flow at the cell boundaries.

With any of the embodiments described above, important features of the design of the pyrometallurgical system are the conceptual division of the system's vessel into unit cells of generally uniform and regular size and shape and the provision of a mechanical stirrer centered in each of those cells. This arrangement permits, in commercially-sized pyrometallurgical systems, improved performance heretofor limited to pilot plant sized furnaces (such as shown, for example, in the above-mentioned U.S. Pat. No. 3,861,660). The action of the stirrers, of course, is to pump molten material radially outward at the depth of the stirrer, with a concomitant inward radial flow at other depths. This cellular flow pattern conduces to improved uniformity of both temperature and composition within the molten material, improved heat transfer and mechanical mixing between various constituents of the molten material (and especially between the molten material and a substance added to it, such as coal dust), and permits the furnace to be operated at high power densities, since the heat delivered by the electrodes is more uniformly distributed to the molten material and thus "hot spots", which could rapidly damage the vessel lining, are unlikely to develop.

In addition to the pumping action of the stirrers, there is a certain amount of circumferential, or rotational, flow within each unit cell. To facilitate the various flow patterns, it is preferred to rotate each adjacent pair of stirrers with opposite rotational senses, thereby assuring the reinforcement of flow patterns at the boundaries of the unit cells.

As will be understood by those skilled in the art, the benefits of the present invention can be realized in a wide variety of pyrometallurgical systems and operations. Thus, for example, the array of stirrers can be provided in a vessel which itself is a furnace for changing the temperature of a material contained in the vessel (i.e., either melting the material or elevating its temperature to a preferred range). The vessel may also be one to which a previously heated molten material has been delivered with the temperature of the material being merely maintained in the vessel. Thus, as used herein, and specifically in the claims, the expression "maintaining a material in a molten state" is intended to encompass the entire range of pyrometallurgical systems and operations where the array of stirrers according to the present invention can be used to promote reactions, increase homogeniety, enhance uniformity of temperature, etc.; whether or not the material is melted in the vessel associated with the stirrers, or elsewhere. Indeed, in the example given above, a portion of the slag was merely maintained in a molten state in the vessel and another portion was actually melted in that vessel.

While particular preferred embodiments of the present invention have been illustrated in the accompanying drawings and described in detail herein, other embodiments are within the scope of the invention and the following claims.

We claim:

1. A pyrometallurgical system for maintaining a material in a molten state, comprising a vessel for the material, said vessel having an internal shape, in a horizontal cross section, which is dividable into a predetermined number of substantially equiaxed cells of substantially uniform size, a plurality of mechanical stirrers projecting into said vessel for stirring molten material therein, each stirrer being substantially centered in a cell, drive means for rotating each stirrer with a predetermined sense of rotation, and heating means for supplying heat to the contents of said vessel.

2. The system of claim 1 wherein said heating means comprise a plurality of power electrodes projecting into said vessel.

3. The system of claim 2 wherein said vessel has a cover having openings therein for said stirrers and electrodes to project downward through said holes into said vessel.

4. The system of claim 2 wherein at least two said electrodes are provided intermediate each pair of adjacent stirrers, each of said electrodes intermediate said stirrers being offset on opposite sides of a first reference line connecting the centers of the associated pair of adjacent stirrers, enabling said two electrodes to supply power to the contents of said vessel without substantially interfering with the flow patterns produced by said stirrers.

5. The system of claim 1 wherein said cells are substantially square.

6. The system of claim 1 wherein said heating means are positioned with respect to said stirrers so as to not substantially interfer with the flow patterns produced by said stirrers.

7. The system of claim 1, wherein said drive means rotate each pair of adjacent stirrers with opposite senses of rotation.

8. A pyrometallurgical system for maintaining a material in a molten state, comprising a vessel for the molten material, said vessel having a substantially circular internal shape in a horizontal cross section, three power electrodes projecting downwardly into said vessel at the apexes of an isosceles triangle centered within said circular shape, thereby enabling a substantially uniform horizontal distribution of power delivered to the molten material, and a stirrer assembly comprising a mechanical stirrer projecting downwardly into said circular vessel and coaxial therewith and means for rotating said mechanical stirrer to produce circulation of molten material in any vertical plane through a diameter of the vessel, thereby enabling a substantially uniform vertical distribution of power delivered to the molten material.

9. The method of treating a pyrometallurgical material comprising the steps of charging a vessel with a liquid pyrometallurgical material, stirring said liquid pyrometallurgical material in said vessel with a plurality of mechanical stirrers supported in a symmetrical array with respect to said vessel, adding solid pyrometallurgical material to said stirred liquid pyrometallurgical material in said vessel, heating the contents of said vessel sufficiently to cause said solid pyrometallurgical material to become molten without a decrease in the temperature of the total molten material in the vessel after the melting of said solid material, while continuing said stirring.

10. The method of claim 9 wherein said pyrometallurgical material comprises slag.

11. The method of claim 9 wherein the material in said vessel is stirred at a faster rate after the addition of said solid pyrometallurgical material than the rate prior to said addition 12. The method of claim 9 wherein adjacent pairs of stirrers in said array are rotated with opposite senses of rotation.

* * * * *